US006887585B2

(12) United States Patent
Herbst-Dederichs

(10) Patent No.: US 6,887,585 B2
(45) Date of Patent: May 3, 2005

(54) THERMALLY APPLIED COATING OF MECHANICALLY ALLOYED POWDERS FOR PISTON RINGS

(75) Inventor: Christian Herbst-Dederichs, Burscheid (DE)

(73) Assignee: Federal-Mogul Burscheid GmbH, Burscheid (DE)

( * ) Notice: Subject to any disclaimer, the term of this patent is extended or adjusted under 35 U.S.C. 154(b) by 2 days.

(21) Appl. No.: 10/363,341

(22) PCT Filed: Aug. 17, 2001

(86) PCT No.: PCT/EP01/09514

§ 371 (c)(1),
(2), (4) Date: Mar. 3, 2003

(87) PCT Pub. No.: WO02/24970

PCT Pub. Date: Mar. 28, 2002

(65) Prior Publication Data

US 2003/0180565 A1 Sep. 25, 2003

(30) Foreign Application Priority Data

Sep. 21, 2000 (DE) ..... 100 46 956

(51) Int. Cl.[7] ..... B22F 5/02; B22F 3/115; B22F 9/04; B32B 15/04; C22C 19/05

(52) U.S. Cl. ..... 428/546; 428/569; 428/660; 428/663; 428/666; 428/937; 29/888.074

(58) Field of Search ..... 428/546, 569, 428/660, 663, 666, 937; 29/888.074

(56) References Cited

U.S. PATENT DOCUMENTS

| | | | | | |
|---|---|---|---|---|---|
| 3,556,747 | A | * | 1/1971 | Hyde et al. | 428/564 |
| 4,681,817 | A | * | 7/1987 | Shinada | 428/549 |
| 5,713,129 | A | * | 2/1998 | Rastegar et al. | 29/888.04 |
| 6,562,480 | B1 | * | 5/2003 | Stong et al. | 428/546 |

FOREIGN PATENT DOCUMENTS

| | | | |
|---|---|---|---|
| DE | 19700835 | * | 7/1997 |
| EP | 0 440 437 | * | 8/1991 |
| EP | 0 559 229 | * | 9/1993 |
| JP | 62099449 | * | 5/1987 |

* cited by examiner

*Primary Examiner*—Deborah Jones
*Assistant Examiner*—Jason Savage
(74) *Attorney, Agent, or Firm*—Howard & Howard

(57) ABSTRACT

The invention relates to a wear-resistant coating used for bearing surfaces and flanks of piston rings in internal combustion engines. The wear-resistant inventive coating is obtained by mechanically alloying powders which form a metallic matrix with hard material dispersoids and lubricant material dispersoids. The coating is then thermally applied to the workpieces, especially by means of high velocity oxygen fuel spraying (HVOF). The workpieces coated are bearing surfaces and parts of flanks pertaining to piston rings in internal combustion engines.

13 Claims, 1 Drawing Sheet

THERMALLY APPLIED COATING OF MECHANICALLY ALLOYED POWDERS FOR PISTON RINGS

FIELD OF THE INVENTION

The present invention relates to a wear-resistant coating for use on the bearing surfaces and flanks of piston rings in internal combustion engines. The wear-resistant coating according to the invention is obtained by mechanically alloying powders that form a metallic matrix with hard material dispersoids and lubricant material dispersoids. The coating is then thermally applied to the workpieces, in particular by means of high-velocity flame (HVOF) spraying. The workpieces are the bearing surfaces and flank parts of piston rings in internal combustion engines.

The invention therefore relates particularly to manufacturing and assembly of coatings of mechanically alloyed powders having tribologically optimal properties that are used as the starting materials for coating the piston ring surfaces using thermal methods; for example, by means of thermal spraying and using the coatings obtained using the aforesaid powders on, for instance, piston rings of internal combustion engines.

BACKGROUND & BRIEF SUMMARY OF THE INVENTION

By their constant contact at the cylinder barrel, piston rings are subject to constant sliding wear. This is expressed both in the abrasive degradation of the piston ring surface or its coating and in the partial transfer of material from the cylinder surface to the piston ring surface and vice versa. It is possible by using adapted coatings to minimize these negative affects. Consequently, particle-reinforced hard chromium layers exhibit better resistance to abrasion than uncoated or nitrated rings (see EP 217126 B1), but also better than conventional hard chromium layers or plasma sprayed layers on a molybdenum base. Nevertheless these coatings, too, lapse into the borderline region of their performances, because of the increasing pressure and temperature parameters in modern internal combustion engines. Therefore, new coatings are required that provide even less abrasion and higher resistance to abrasion versus the currently available ones. Ceramics are suitable in principle as materials that can fulfill these requirements. They have excellent resistance to abrasion and, because of their non-metallic bonding properties, have very low tendency to adhere in comparison to metal alloys.

Ceramics can also be applied directly to piston rings using various coating methods. So, for example, they can be directly deposited using vaporization methods (PVD or CVD). The drawback here is that the amount of material deposition per unit of time for this application are much too low and are therefore uneconomical.

Plasma spraying, on the other hand, provides relatively high deposition rates but the coatings are generally subjected to tensile stresses, whereby they run the risk of cracking and breaking out. This is aggravated generally by the very brittle character of the ceramics.

Thermal spraying techniques using nano-crystalline hard metals (nano-crystalline=1 to 100 nm) are exhibiting increasingly positive results. As early as the late 1980s nano-carbide reinforced materials were being processed in layers using vacuum plasma spraying techniques. Higher hardnesses in the layers produced with comparatively lower hard material content can be obtained using this method. The coatings exhibit clearly higher ductility and resulting higher impact resistance than conventional reinforced materials. However, high-velocity flame spraying technology first made it possible to create powder morphologies also in the layer. Nano-oxide reinforced metals are primarily sprayed using high-velocity flame (HVOF) spraying. The spray powders are manufactured using high-energy milling. This process is particularly interesting for thermal spray powders, because it results in a number of special powder properties. The density of stacking errors, defects and deviations are increased on the surface of the powder by the crushing and milling process, whilst particle sizes can be reduced to nano-crystalline dimensions. These permanently freshly generated surfaces are characterized by high activity, so that even high-strength oxide-metal and carbide-metal combinations can be produced.

It is therefore desirable to combine the good tribological properties of the ceramics with the good mechanical properties of metals. It is therefore conceivable, for instance, to introduce ceramic particles into a metallic matrix, whereby ductile and viscous compounding of the hard and in part brittle ceramic particles is possible. The ceramic particles can then, with appropriate exposure at the surface, assume the tribological roles, while the metal matrix can take on the mechanical loads and breakdown stresses by deformation, if necessary.

Such a combination concept is already being realized today. So, for example, powdered hard metals (WC—Co) or cermets (NiCr—CrC) are being processed to layers by means of thermal coating processes. The basis for this is either a powder mixture or a compound powder. As a rule, however, mechanical mixtures provide the lowest coating quality, since in this case compound formation occurs only in the coating process and the hard materials must be relatively large due to their required fluidity. Compound powders are generally manufactured by agglomeration to so-called micro-pellets. In this process micro-fine starting powder is processed in a spray-drying process to powders that can be processed; in other words, primarily to fluid powders. In order to increase the strength of the agglomerate or to obtain certain agglomerate densities, they are in most cases subsequently sintered. Another possibility for manufacturing compound powders is mixing the components with subsequent sintering to the block. In this case, the powder is obtained by crushing and milling the block. Furthermore, compound powders are manufactured by enveloping, wherein, for example, a hard material powder is chemically or physically coated with a metallic element—so-called cladding—wherein fine metallic powders are adhered to the hard material core by a spray-drying process.

Characteristic of the manufacturing of common compound powders is that the formation of the compound in the powder generally requires a sintering process, because the powder can otherwise degrade into its starting components in course of the coating processes and lose the advantageous compound effects in the coating. This is all the more important the greater the processing forces during coating. These are especially high in the high-velocity spray methods, wherein the powder is processed in a supersonic gas current. Moreover, optimal binding between the ceramic and metallic binding phase is required for fulfilling the tribological tasks and can be obtained particularly by chemical-metallic binding.

The drawback in the required sintering is that on the one hand the economy of the powder is reduced and on the other hand the starting ingredients must be capable of being subjected to sintering. This is evident especially in the case of WC—Co combinations but is absent, however, in the case of those combinations that are of interest for economical and tribological reasons comprised, for example, of metallic binders and oxide-ceramic hard materials. Therefore, until now, such powders could not be used successfully for thermally coating piston ring surfaces.

A support for thermally coating metal parts such as, for instance, piston rings and cylinder barrels, is disclosed in DE 19700835 A1. The composite powder used in said document is a mixture of carbides, metal powder and solid lubricants which is processed using a high-velocity oxy fuel spraying method to a self-lubricating composite layer. The composite particles comprised of CrC and NiCr are mixed with the solid lubricants for creating the composite powder.

The drawback in this type of production of the composite powder according to DE 19700835 is the fact that in order to obtain the necessary fluidity, as a condition of processing using the high-velocity flame spray method, relatively coarse granular particles must be formed. In the case of these mixed, non-spherical composite powders the granule size of the solid lubricant particles must be >20 $\mu$m so that the composite powder has the necessary fluidity for spraying in the high-velocity flame method. These coarse particles require a concentrated accumulation of solid lubricant phases in the coating and this, in turn, has negative ramifications on wear, since the coarse and thus relatively large solid lubricant zones can break out and due to their size are available only punctally as a lubricant.

It is, therefore, the object of the present invention to expand the coating materials in terms of powder technology so that tribologically optimized surfaces are created for the piston ring.

Therefore, a thermally applicable coating composition for the bearing surfaces of piston rings etc. is provided, wherein said composition can be manufactured using mechanically alloyed powders.

According to the invention, said object is achieved by the coating and by the piston ring as described and claimed herein.

BRIEF DESCRIPTION OF THE SEVERAL VIEWS OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

Figure 1:
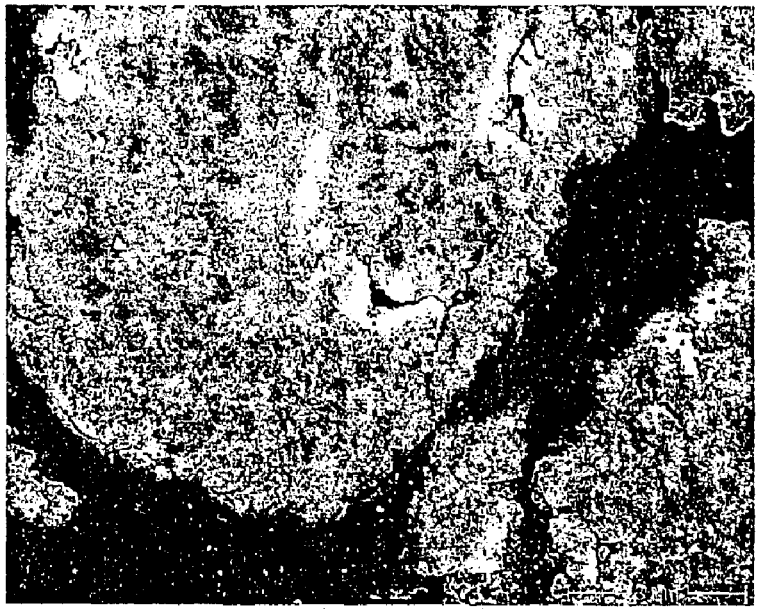
FIG. 1 is an illustration of wear-resistance coating having a mechanically alloyed powder mixture of NiCr-34$Al_2O_3$.

Referring to the Figures, wherein like numerals indicate like or corresponding parts throughout the several views, a wear-resistant coating for the bearing surfaces and flanks of piston rings is disclosed.

The wear resistant coating includes a mechanically alloyed powder mixture obtainable by mechanical alloying. The powder mixture includes a metallic matrix and a ceramic phase. The metallic matrix comprises at least one of nickel and iron and at least one of a nickel and an iron-alloying element selected from carbon, silicon, chromium, molybdenum, cobalt, nickel, and iron. The at least one of the nickel and iron is present in a quantity of from 5 to 70% by volume relative to the total powder mixture, whereby the alloying elements do not exceed 70% by weight of the metallic matrix.

In one embodiment, the metallic matrix is further defined as comprising nickel and chromium, wherein the chromium is present in an amount up to 50% by weight of the metallic matrix. In another embodiment, the metallic matrix may comprises nickel, chromium, and molybdenum, wherein the chromium is present in an amount of to 30% by weight of the metallic matrix and the molybdenum is present in an amount of up to 30% by weight of the metallic matrix.

In yet another embodiment, the metallic matrix includes iron and chromium, wherein the chromium is present in an amount of up to 50% by weight of the metallic matrix. In still another embodiment, the metallic matrix may include iron, chromium, and molybdenum, wherein the chromium is present in an amount of up to 30% by weight of the metallic matrix and the molybdenum is present in an amount of up to 30% by weight of the metallic matrix.

The ceramic phase is selected from at least one of $Al_2O_3$, $Cr_2O_3$, $TiO_2$, $ZrO_2$, $Fe_3O_4$, TiC, SiC, CrC, WC, BC or diamond. The ceramic phase has a particle size of up to 10 $\mu$m and the ceramic is present in an amount of from 30 to 95% by volume relative to the total powder mixture. Preferably, the ceramic phase is further defined as being present in an amount of from 70 to 90% by volume relative to the powder mixture. The preferred ceramic phase is $Al_2O_3$.

The wear-resistant coating further includes a powdered solid lubricant selected from the group comprised of graphite, hexagonal boron nitride, polytetrafluorethylene. The powdered solid lubricants are present in an amount of up to 30% by volume of the powder mixture.

The wear-resistant coating also includes at least one additive selected from the group of elements Ti, Zr, Hf, Al, Si, P, and B. The additive is present in an amount of up to 2% by weight relative to the total alloying element of the metallic matrix.

The wear resistant coating is particularly useful as a coating for engine components, for example, but not limited to, a piston ring for internal combustion engines. The powder mixture is applied to the engine components having a thickness of from 0.01 to 1.0 mm. The powder mixture is applied by means of thermal spraying, and preferably by means of high-velocity flame (HVOF) spraying.

According to the invention, therefore, the starting powder is mechanically alloyed, in particular in an attritors, hammer mill or a ball mill. In all of these methods according to the invention, the starting powders are reduced by crushing and simultaneously kneaded into each other so that, even without sintering, a compound powder is obtained. By so doing, combinations of materials that are not amenable to sintering, such as metals and oxides, can be worked into composite powders. This technology is, for example, used in large-scale methods for manufacturing the so-called ODS alloys for high-temperature applications, wherein the metal matrix is alloyed with approximately 2% by weight of oxides reduced to nano-dimensions.

The invention therefore relates to manufacturing mechanically alloyed powders and using such powders in thermal coating processes for coating the bearing surfaces and flanks of piston-rings and the piston rings coatings so produced. The powder mixtures according to the invention have a suitable grain size. In particular, grain sizes of 5–80 μm, particularly preferably 5–60 μm, are used for thermal sprays. According to the invention, the starting powder consists of a metallic matrix and at least one ceramic phase for increasing wear resistance of the metallic matrix. The ceramic phases in the starting powders or in the finished coating have a cross-section of less than 10 μm. Preferably they have a size ranging from a few nanometers to several micro-meters. The metallic matrix of the powder mixture and the coating include particularly alloying elements based on iron, nickel, chromium, cobalt, molybdenum.

The powder mixture can comprise the metallic matrix and at least one solid lubricant phase for enhancement of the lubricant properties of the matrix. The solid lubricant phase in the starting powder has grain sizes of <20 μm, preferably <10 μm. Graphite, hexagonal boron nitride or polytetrafluoro ethylene, for example, can be used as solid lubricant particles.

In contrast with DE 19700835 A1, a further advantage of the inventive material is provided in that the dispersoids and solid lubricants are milled to a composite powder; that is, mechanically alloyed. In this fashion very fine composite particles can be produced that in turn are reproduced in the coating as extremely finely distributed solid lubricant phases. These extremely finely distributed solid lubricant phases make possible an optimal and uniform distribution of the lubricant, whereby coating wear is reduced.

It is further possible to incorporate into the inventive material also hard material particles for the ceramic phase selected from the group comprised of wolfram carbide, chromium carbide, aluminum oxide, silicon carbide, boron carbide, titanium carbide and/or diamond.

Mechanical alloying enables two essential advantages, while affording economic advantages, versus all other methods of manufacturing powders. On the one hand, in terms of process methodology, relatively simple compound powders such as metal+oxide ceramic and metal+diamond can be manufactured for subsequent coating processing by means of thermal methods. When this is done, the hard material content in the metallic matrix can be considerably greater than 50% by volume, whereby the properties of the hard material phases can be clearly optimized than with lower contents, that are currently achieved, for instance, in galvanic chromium dispersion coatings. As a further advantage, practically any finely and uniformly distributed hard material phases can be produced in the optionally composed metallic matrix. By doing this the matrix can be specifically optimized to abrasion and burn trace resistance and a certain portion of the larger hard phases can perform purely tribological functions.

When manufacturing mechanically alloyed powder mixtures, the starting materials are filled into the mill and the milling process begun. The powders are, depending on their formability, broken up and formed by the impact processes that are produced by the balls arranged in the mixer or by contact with the chamber walls. Ceramics, for instance, that have little formability and are continuously finely crushed. Experiments have shown that these can be reduced down to nano-dimensions. It has also been shown that the metallic matrix undergoes increases in strength, when the ceramic phases contained therein go below the one-micron limit. In contrast, metals having formability capacities are maximally deformed, but in part by cold working are also broken. In the course of the milling process, the broken up hard material phases are then alloyed into the metallic matrix and kneaded by the ongoing mill movements into powder fractions that can be processed. In this process an excellent bonding between oxide ceramics and metal, for example, occurs even without sintering. This is explained in that the breaking process continuously creates fresh, energy-rich surfaces on the ceramic and those surfaces have high microscopic affinity. By the high mechanical impulses during the milling, the metallic and ceramic surfaces are tightly compacted with each other so that interfacial reactions at the atomic level probably occur. Subsequent sintering of the powder can, in the individual case, provide a further increase in ceramic—metal cohesion.

By incorporation of the various starting materials at different points in time, the hard material sizes in the powder can be specifically adjusted. Furthermore, not only can a ceramic phase and a metallic matrix be used for this but practically any number of same. Further still, a portion of solid lubricants as may be beneficial to the application can also be added to the powder.

The powder is then applied using a thermal coating method, whereby thermal spraying, laser coating and surfacing by welding and soldering can be used with particularly satisfactory results.

In experiments, high-velocity flame (HVOF) spraying, a technique from thermal spraying, has been used predominantly for this purpose.

Figure 2:
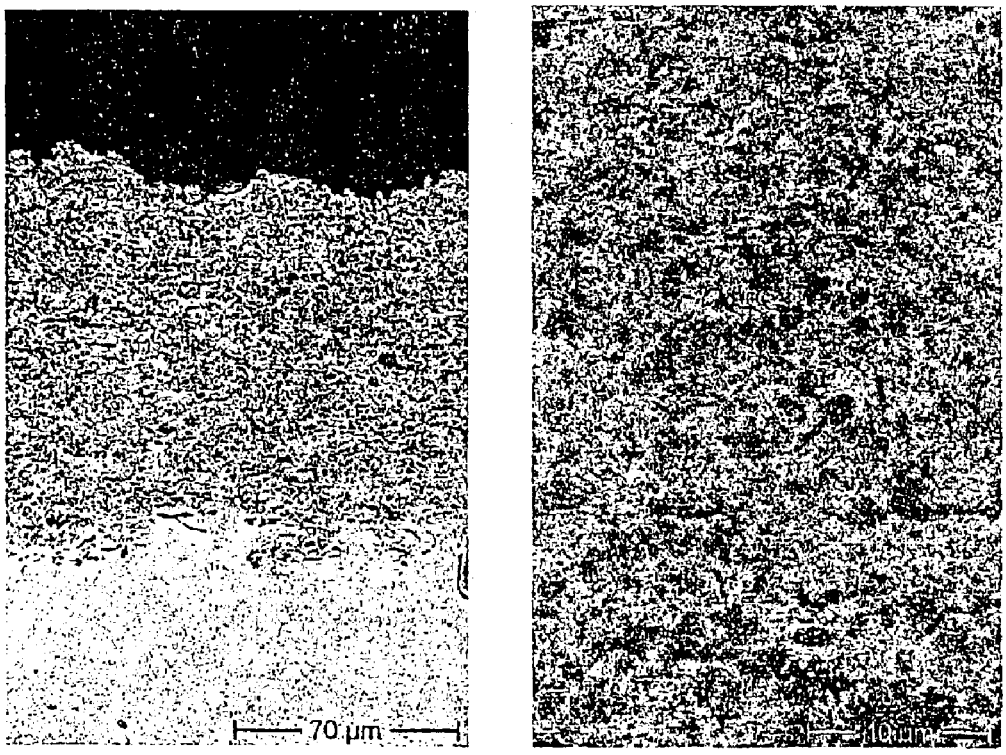
FIG. 2 is an illustration of the coating of FIG. 1 applied in a high-velocity flame (HVOF) spraying exhibiting an identical microstructure.

The invention will be more completely explained using the following examples with reference to FIG. 1 and FIG. 2.

EXAMPLE 1

In Example 1 conventional aluminum oxide spray powder was milled with a conventional spray powder comprised of NiCr in volumetric proportions of 1:1. A powder of extremely finely distributed aluminium oxide phases (gray) resulted after the milling process (FIG. 1: mechanically alloyed powder NiCr-34$Al_2O_3$). After processing by means of HVOF a very satisfactorily adhering, thick coating was obtained that exhibited the same microscopic structure as the powder (FIG. 2: HVOF sprayed coating exhibits identical microstructures).

EXAMPLE 2

In Example 2 up to 20% by volume of a powdered solid lubricant was alloyed with the powder of Example 1, which is demonstrably present in the coating after processing using HVOF and clearly improves the frictional behavior of the coating on the piston ring.

EXAMPLE 3

In Example 3, additional metallic elements such as Mo were added by alloying to the matrix of Example 1, in order to improve the tribological properties of the piston ring coating. The Mo powder is only slightly finely milled in the milling process due to its high viscosity; however, it occurs in the powder and in the coating as a uniformly distributed, excellently imbedded phase. The burn trace behavior of the piston ring coating was demonstrably improved in this way.

EXAMPLE 4

In Example 4, 50% by volume of two different ceramic phases (aluminum oxide, zirconium oxide) were mixed into the powder of Example 1. The ceramics were added at different points in time to the milling process, whereby the various ceramic phases have different fractions in the HVOF coating. Using this procedure, the matrix hardness can be specifically controlled by the one ceramic without the tribologically required hard phase of the other ceramic being negatively influenced. Thereby the abrasive resistance of the piston ring coating can be clearly improved.

EXAMPLE 5

In Example 5, an extremely fine diamond dust was added to and alloyed with a commercial NiCr spray powder. After processing by means of HVOF, an increase in wear resistances versus the unalloyed matrix was observed, which has an advantageous affect on the tribological properties of the piston ring coating.

What is claimed is:

1. A piston ring for internal combustion engines, said piston ring formed by the process of:

providing a piston ring having at least one of a flank surface and a bearing surface, mechanically alloying a metallic matrix and a ceramic phase to provide a compound powder mixture for applying to said at least one of said flank surface and said bearing surface, wherein said metallic matrix is present in an amount of from 5 to 70% by volume and said ceramic phase is present in an amount of from 30 to 95% by volume, both relative to said total compound powder mixture, wherein said metallic matrix comprises at least one of nickel and iron and an alloying element selected from at least one of carbon, silicon, chromium, molybdenum, cobalt, nickel and iron, whereby said alloying elements do not exceed 70% by weight of said metallic matrix; and wherein said ceramic phase is selected from at least one of $Al_2O_3$, $Cr_2O_3$, $TiO_2$, $ZrO_2$, $Fe_3O_4$, TiC, SiC, CrC, WC, BC or diamond, and wherein said ceramic phase has a particle size of up to 10 $\mu$m, and thermal spraying said compound powder mixture to at least one of said flank surface and said bearing surface.

2. A piston ring according to claim 1, wherein said compound powder mixture has a thickness of from 0.01 to 1.0 mm.

3. A wear-resistant coating for the bearing surfaces and flanks of piston rings comprising:

a compound powder mixture comprising a metallic matrix and at least one ceramic phase mechanically alloyed with one another to form said compound powder mixture;

said metallic matrix comprising at least one of nickel and iron and an alloying element selected from at least one of carbon, silicon, chromium, molybdenum, cobalt, iron, and nickel, whereby said alloying elements do not exceed 70% by weight of said metallic matrix; and said ceramic phase selected from $Al_2O_3$, $Cr_2O_3$, $TiO_2$, $ZrO_2$, $Fe_3O_4$, TiC, SiC, CrC, WC, BC or diamond and having a particle size of up to 10 $\mu$m;

said alloying element present in an amount of from 5 to 70% by volume and said ceramic phase present in an amount of from 30 to 95% by volume, both relative to said total compound powder mixture; and wherein said compound powder mixture is applied by means of thermal spraying.

4. A wear-resistant coating according to claim 3 further comprising a powdered solid lubricant selected from the group comprised of graphite, hexagonal boron nitride, polytetrafluorethylene, wherein said powdered solid lubricants are present in an amount of up to 30% by volume of said powder mixture.

5. A wear-resistant coating according to claim 3 further comprising at least one additive selected from the group of elements Ti, Zr, Hf, Al, Si, P, and B, wherein said additive is present in an amount of up to 2% by weight relative to said total alloying element of said metallic matrix.

6. A wear-resistant coating according to claim 3 wherein said ceramic phase is further defined as being present in an amount of from 70 to 90% by volume relative to said compound powder mixture.

7. A wear-resistant coating according to claim 3 wherein said metallic matrix is further defined as comprising nickel and chromium, wherein said chromium is present in an amount up to 50% by weight of said metallic matrix.

8. A wear-resistant coating according to claim 7 wherein said metallic matrix is further defined as comprising nickel, chromium, and molybdenum, wherein said chromium is present in an amount of up to 30% by weight of said metallic matrix and said molybdenum is present in an amount of up to 30% by weight of said metallic matrix.

9. A wear-resistant coating according to claim 3 wherein said metallic matrix is further defined as comprising iron and chromium, wherein said chromium is present in an amount of up to 50% by weight of said metallic matrix.

10. A wear-resistant coating according to claim 9 wherein said metallic matrix is further defined as comprising iron, chromium, and molybdenum, wherein said chromium is present in an amount of up to 30% by weight of said metallic matrix and said molybdenum is present in an amount of up to 30% by weight of said metallic matrix.

11. A wear-resistant coating according to claim 6 wherein said ceramic phase is further defined as comprising $Al_2O_3$.

12. A wear-resistant coating according to claim 3 wherein the compound powder mixture is mechanically alloyed in at least one of a hammer mill, a ball mill and an attritor.

13. A piston ring according to claim 1 wherein said thermal spraying is further defined as high velocity flame (HVOF) spraying.

* * * * *